United States Patent [19]

Lueneberg et al.

[11] 4,250,687

[45] Feb. 17, 1981

[54] PACKAGED TUBES OR RODS

[75] Inventors: Hartmut Lueneberg; Reinhard Maennl; Alfred Grillmeier, all of Mitterteich, Fed. Rep. of Germany

[73] Assignee: Schott-Ruhrglas GmbH, Fed. Rep. of Germany

[21] Appl. No.: 902,073

[22] Filed: May 2, 1978

[30] Foreign Application Priority Data

May 4, 1977 [DE] Fed. Rep. of Germany ... 7714038[U]
Jul. 2, 1977 [DE] Fed. Rep. of Germany ..... 2729966

[51] Int. Cl.[3] ..... B65B 23/00; B65B 27/00; B65B 53/06; B65B 35/50

[52] U.S. Cl. ..... 53/435; 53/442; 53/444; 53/447

[58] Field of Search ..... 53/397, 398, 399, 447, 53/435, 441, 442, 444, 463

[56] References Cited

U.S. PATENT DOCUMENTS

| | | | |
|---|---|---|---|
| 2,547,835 | 4/1951 | Pfeiffer | 53/397 |
| 2,581,561 | 1/1952 | Shaw | 53/399 X |
| 3,133,387 | 5/1964 | Harrison | 53/398 |
| 3,181,956 | 5/1965 | Clark et al. | 53/441 X |
| 3,186,543 | 6/1965 | Minick et al. | 53/339 X |
| 3,187,478 | 6/1965 | Kirkpatrick | 53/397 |
| 3,283,893 | 11/1966 | Durocher et al. | 53/399 X |
| 3,295,290 | 1/1967 | Billingsley et al. | 53/442 X |
| 3,564,810 | 2/1971 | Faletti et al. | 53/463 |
| 3,640,048 | 2/1972 | Zelnick et al. | 53/442 |
| 3,643,396 | 2/1972 | Togashi et al. | 53/463 X |
| 3,672,116 | 6/1972 | Ingmarson | 53/397 |
| 3,875,723 | 4/1975 | Sundin | 53/442 |
| 3,897,671 | 8/1975 | Higgins | 53/442 |
| 3,942,298 | 3/1976 | Matzinger et al. | 53/463 X |
| 3,996,720 | 12/1976 | Hayduchok | 53/435 |

FOREIGN PATENT DOCUMENTS

| | | | |
|---|---|---|---|
| 1177561 | 12/1958 | France | 53/399 |

*Primary Examiner*—Horace M. Culver
*Attorney, Agent, or Firm*—Hill, Van Santen, Steadman, Chiara & Simpson

[57] ABSTRACT

Packaging of tubes or rods is disclosed. The tubes or rods consist of a brittle material such as glass or ceramics. In a method for packaging, the tubes or rods are arranged in one package in the tightest possible packaging form. This package is encased by a hood preferably consisting of a film of synthetic material which is fitted over the package under stress and which thereby locks the tubes or rods in position. A plurality of such packages can be stacked on a conventional pallet and can be encased by an additional hood locking this stack in position.

12 Claims, 4 Drawing Figures

PACKAGED TUBES OR RODS

BACKGROUND OF THE INVENTION

The present invention relates to a bundle of tubes or rods in which the tubes or rods are held together in tight packaging form and are enclosed at least at their ends by a film such that the ends and thus, for example, the interior of the tubes, are safeguarded against contamination.

The transport of rod-shaped articles, particularly of tubes or rods of a brittle material such as glass or ceramics, poses a great problem due to the fragility of these articles. It was also not possible until now to transport glass tubes, for example, in the condition of original sterility in which they are produced during a tube stretching process.

The conventional methods for packaging glass tubes, for example, consist in that either a bundle of such tubes is wrapped into packing paper, tightened with string or taped, or that such tubes are laid in appropriate packing crates of heavy cardboard. It is also known to push hoods of stiff paper carton onto the ends of bundles of such tubes so that a tube package is formed.

All these types of packaging have serious disadvantages. The tubes abut one another relatively loosely in the bundles so that the mechanical strength of the total package is not very great. Shock and impact relatively easily break the tubes; fragments, particularly particles, penetrate the interior of the tube. The contamination of packaged tubes during the transport is generally very disadvantageous, because the tubes are often further processed into articles such as ampules for which the highest sterility requirements are made.

SUMMARY OF THE INVENTION

It is an object of the present invention to provide a novel packaging for tube or rod-shaped objects, said packaging being of great mechanical strength and which protects the packaged objects from contamination at least at their ends.

This objective is obtained with a tube or rod package in accordance with the invention, characterized in that the tubes or rods in the package are held together in the tightest packaging form possible, and that this package is held together by a film such that the package can be palletized or stacked and that at least the ends of the tubes or rods, respectively, are sealed to the exterior by means of this film.

The film, preferably produced from a transparent synthetic material such as, for example, a polyolefin, can enclose the ends of the package in the shape of a hood or cap; however, it can also enclose the total package so that its total content is protected from contamination. The film can be thermally shrunk or mechanically stretched in a manner known per se. By means of the packaging in accordance with the present invention, the bundle has a high mechanical strength to which all packaged components contribute. The load capacity and stacking capability of the packages is thereby guaranteed.

The articles are advantageously packaged such that the bundle exhibits a rectangular or square form in cross section. The bundles, nevertheless, can also exhibit a different cross section form such as a triangle or circle; however, the stacking capability and particularly the capability for palletizing is most advantageous for the rectangular or square form.

In accordance with one particular embodiment of the invention a plurality of packages can compose a large bundle together with a conventional pallet, said bundle which itself can be stacked again and encased by an additional film. This film can consist of the same material as the film stretched over the individual package.

The present invention is particularly useful for the packaging of tubes consisting of brittle material such as glass or ceramics, but, however, can be just as advantageously utilized for articles of other materials such as synthetic material, metal, etc.

It is another object of the present invention to provide a new and better method for packing tubes and rods wherein disadvantages of existing methods are avoided. According to the inventive method, brittle objects such as glass or ceramics are cut to equal length. The cut objects are arranged into one package in which the objects lie next to one another in a closest possible packaging form. At least two ends of the package are encased with a hood material comprising a flexible material for locking the objects in tight fashion in the closest possible packaging form.

DESCRIPTION OF THE PREFERRED EMBODIMENTS

Figure 1:
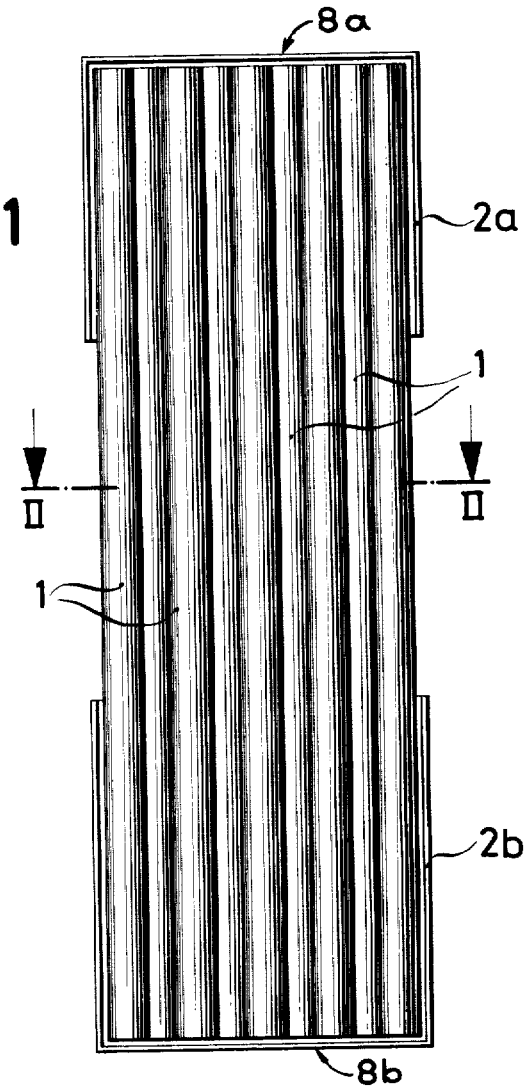
FIG. 1 illustrates a top view of a tube package in accordance with the invention.

Tubes 1 are held together in the packages in the tightest possible packaging form and are encased by a film 2. In the sample embodiment in accordance with FIG. 1 they are encased by means of two film hoods 2*a* and 2*b* at the two ends of the package.

Figure 2:
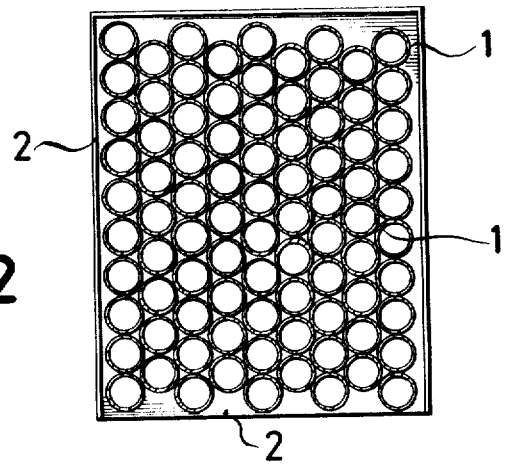
FIG. 2 illustrates a cross-section through a tube package of rectangular form.
Figure 3:
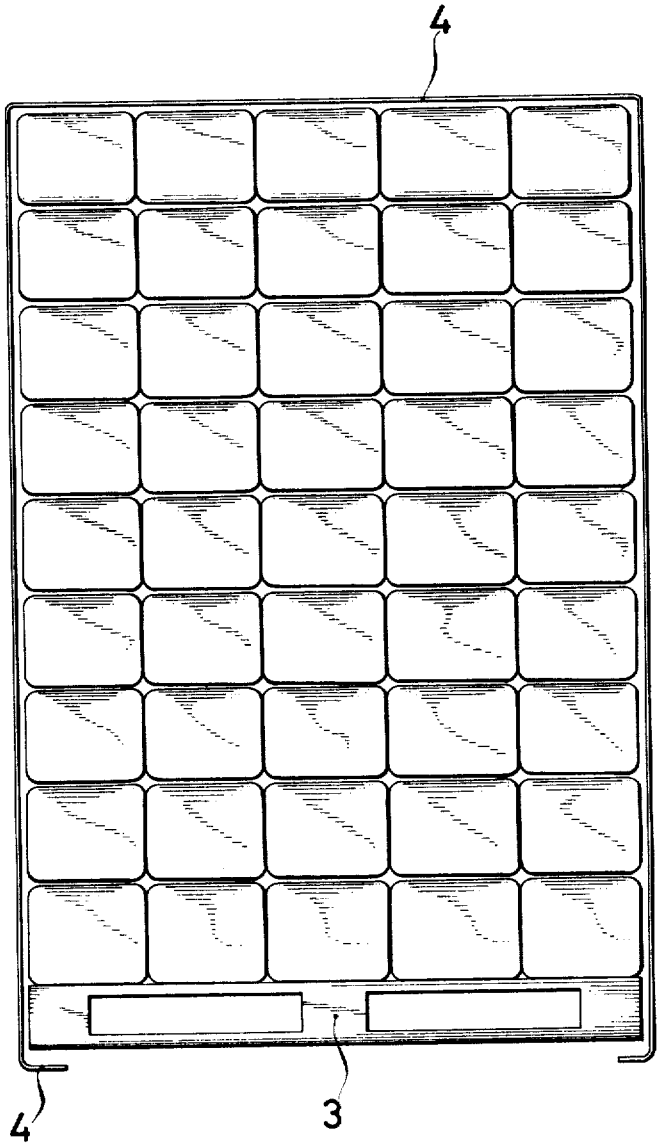
FIG. 3 shows a lateral view of a large bundle of multiple tube packages on a pallet.

The package in accordance with FIG. 2 has a rectangular cross-section form. 45 packages in accordance with FIG. 2 are stacked on a pallet 3 in a bundle in accordance with FIG. 3, and the total is encased by an additional film 4.

The new method consists of several consecutive method steps.

Figure 4:
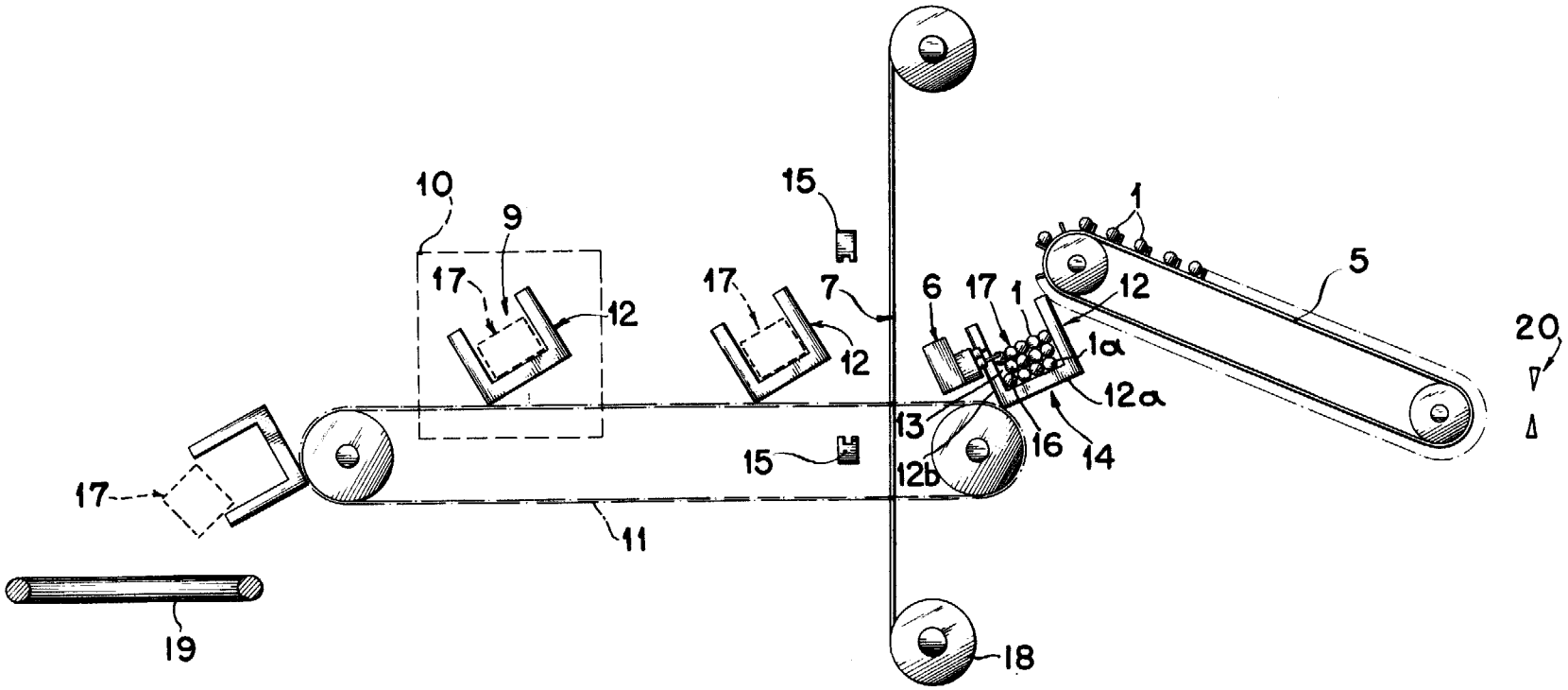
FIG. 4 shows a method to produce tube packages.

As shown in FIG. 4:

Separating: Tube pieces 1 of equal length are cut at a cutting station 20 from a stretched, endless tube string. Tubes, for example of 10–15 mm diameter, are commonly cut into lengths of, for example, 150 cm, for transport on a band conveyor 5. The cutting proceeds in a conventional manner, for example, by scratching and thermal separation.

Collecting and Packaging: The tubes cut to length are conveyed to a packing and collecting station 14 in which they are packed into a bundle one lying parallel to the other, and wherein all tube ends terminate in the same plane. The tubes in the bundle are to be situated in the tightest possible packaging form. The tubes 1 are arranged in layers one above the other such that the tubes of an in-between layer are situated in the gap between two tubes, not only for the layer below, but also for the layer above (tightest ball packing).

The collecting and packing, for example, can proceed such that the tubes rolling on a band conveyor 5 or guided by gripping devices fall into a packing and collecting station 14, preferably consisting of a type of container 12 whose cross-section form corresponds with the desired cross-section of the tube package to be formed, said container 12 being arranged in a tilted manner so that its base surface 12*a* on which the lowest tube layer 1*a* is formed, forms an acute angle with the horizontal.

The tubes 1 consecutively fall in short intervals from the band conveyor 5 into the packing and collecting station 14 and roll on the inclined base surface 12*a* of the container 12 to the respectively lowest point so that said tubes, viewed in cross-section, form a closed line of adjacent tube cross-sections. As soon as a line is filled, the next tube rolls across this line to the rim or wall 12*b* of the container and remains in the outermost gap 13 between two tubes lying therebelow. In order to avoid the tube rolling past this gap 13, stops 6 can be provided at this point of the packing station, said stops 6 holding the outermost tube 16 of the new line in the necessary distance from the cage wall 12*b*.

A tube package 17 packed in the tightest manner is formed in this way and is transported as a unit. The container can be constructed such that it can be adjusted to arbitrary cross-section forms and sizes for the tube package 17.

Locking into Position: The tube package 17 is conveyed to an encasing station 7, where it is encased by the tightly-fitting hood consisting of a flexible material. The total package 17 can be encased by a hood or the two ends of the elongated tube package are advantageously encased by respective hoods 2*a* and 2*b* so that only a part of the package longitudinal side is encased, for example, approximately 10–30 cm. The hood is expediently formed of a transparent film of synthetic material which can be shrunk, such as polyethylene which is pulled off a roll 18, is wound about the package ends, cut off and sealed alongside of the cutting edge, for example, in welded or glued fashion. The parts of the synthetic material extending over the package ends are folded towards the interior and are sealed in the same manner as the cutting edges of the material.

The shrinking-on of this synthetic material hood is then carried out. This can advantageously result in a so-called "shrinking box", a heating chamber 10 provided over the synthetic material hood, and in which such a high temperature is produced with the aid of hot air by an infrared radiating system or by other heating elements that the synthetic material hood is tightly shrunk over the tube package 17. The film parts folded over at the frontal sides of the tube package 17 are thereby also melted.

The tubes of the package are absolutely tightly locked in position by means of the shrinking-on process. The package 17 thereby has a mechanical strength not achieved until now, and wherein all tubes of the package contribute to strength. Moreover, the frontal surfaces of the tube package are hermetically sealed so that interior portions of the tubes are protected from contamination.

Stacking onto Pallets: The tube packages 17 stabilized and fixed by means of shrinking-on of the synthetic material hoods can now be shipped or stacked onto pallets 3, in the same manner as it is known from conventional tube bundles and packages.

The strong tube packages obtained in accordance with the inventive method are advantageously packed into multiple bundles on conventional pallets 3 by use of a conveyor 19, for example. Due to the stability and mechanical strength of the inventive tube packages not previously obtainable, the packages can indeed be stacked one on top of the other twice the previous height. Until now, two pallets were stacked over one another in a truck, container, or railroad car. With the invention, the same height is obtained with a plurality of bundles. The obtainable space saving is very considerable. In a stack of the conventional type, two pallets are on top of one another with four rows of packages each. A stack of the bundles of the invention contains one pallet with nine rows of stacked packages. In addition, however, with the tube package of the invention, due to the tightest-possible packaging, 20% more tubes are accommodated as in a package of the conventional type of same size.

The tube packages stacked one upon the other on a pallet to double the height possible up to now are advantageously encased by an additional synthetic material hood 4 together with the pallet. The hood can also be shrunk-on in the manner already described.

Instead of shrinking the hood 4 onto the tube package and/or the multiple bundle, the hood can also be attached wherein a stretching film is used which is stretched and brought over the tube package and/or the stack in stretched condition, and then the hood is seated under tensile stress.

The inventive method has the additional substantial advantage that it can be carried out in a sealed chamber into which, for example, purified air is blown in so that the chamber is under a slight overpressure and no contaminating materials can penetrate from the exterior (laminar flow). Accordingly the original sterility, which can never again be produced, is maintained in the interior of the tubes. This is an exceptional advantage, for example, in the utilization of the tubes in the medical field.

The individual method steps can very readily be pulsed by utilizing conventional control techniques so that the total method from the cutting of the tubes to the transporting of the locked tube packages can be carried out completely automatically.

The principal components shown in FIG. 4 are:

20—Cutting Station;
5—Band conveyor for the tubes cut to equal lengths;
6—Stops on the packing container;
14—Collecting-and packing station;
7—Encasing station including a station 15 for cutting and welding the film;
12—Collecting and packing container;
9—Region for shrinking on of the synthetic material hood;
10—Shrinking box or chamber.

Although various minor modifications may be suggested by those versed in the art, it should be understood that we wish to embody within the scope of the patent warranted hereon, all such embodiments as reasonably and properly come within the scope of our contribution to the art.

We claim:

1. A method for packing and stacking the packages, comprising the steps of:

(a) cutting stiff hollow fragile tubular rods selected from the group consisting of glass and ceramics to equal length;

(b) arranging the cut rods into one rectangular package in which the objects lie next to one another in a closest possible packaging form with adjacent rows being offset by approximately one half of a diameter of one of the rods;

(c) encasing at least two ends of the package with a contracting thin flexible synthetic film hood means and contracting the film to lock the objects in tight fashion in said closest possible packaging form and to close off the ends of the rods to seal a hollow interior thereof and prevent dust accumulation therein; and stacking the encased package with other similarly encased packages of said rods such that the packaged rods rather than the synthetic film encasements provide support for the stacking.

2. The method of claim 1 including the further steps of vertically and horizontally stacking the encased package on a pallet with other similarly encased packages and encasing at least a portion of the pallet and the packages with an additional flexible material hood means to lock the packages in position on the pallet.

3. A method in accordance with claim 1, characterized in that said objects are arranged such that the rectangular package has a square cross-section.

4. A method in accordance with claim 1, characterized in that the hood means is provided as a transparent material.

5. A method in accordance with claim 1, characterized in that the contracting film is heat shrinkable.

6. A method in accordance with claim 1, characterized in that the contracting film is stretchable.

7. A method in accordance with claim 1, characterized in that a film of a polyolefin comprising polyethylene is utilized as the film material.

8. A method in accordance with claim 1, characterized in that the two ends of the package are each respectively encased by a separate hood.

9. A method in accordance with claim 1, characterized in that the package is completely encased by a hood.

10. A method in accordance with claim 5, characterized in that the hood means is shrunk over the package and is sealed at the ends of the package.

11. A method in accordance with claim 10, characterized in that the hood means is thermally shrunk and sealed.

12. A method in accordance with claim 11, characterized in that the hood means is stretched over the package before mounting and is brought over the package in the stretched condition for subsequent fitting under stress.

* * * * *